US008678394B2

(12) United States Patent
Wang

(10) Patent No.: US 8,678,394 B2
(45) Date of Patent: Mar. 25, 2014

(54) GIFT STORAGE DEVICE OF GIFT GAME MACHINE AND SELECTION OUTPUT MEANS THEREOF

(75) Inventor: Chih-Chieh Wang, Taichung (TW)

(73) Assignee: Youal-Jifh Enterprise Co., Ltd., Taichung (TW)

( * ) Notice: Subject to any disclaimer, the term of this patent is extended or adjusted under 35 U.S.C. 154(b) by 222 days.

(21) Appl. No.: 13/422,643

(22) Filed: Mar. 16, 2012

(65) Prior Publication Data

US 2013/0244796 A1 Sep. 19, 2013

(51) Int. Cl.
*A63F 7/36* (2006.01)

(52) U.S. Cl.
USPC ..... 273/448; 273/47; 273/454; 273/459; 273/460

(58) Field of Classification Search
USPC ..... 273/440, 445, 446, 447, 448, 454, 455, 273/459, 460
See application file for complete search history.

(56) References Cited

U.S. PATENT DOCUMENTS

| | | | | |
|---|---|---|---|---|
| 7,600,760 | B2 * | 10/2009 | Matsuda et al. | 273/447 |
| 8,016,292 | B1 * | 9/2011 | Yang et al. | 273/451 |
| 8,079,597 | B1 * | 12/2011 | Wei | 273/451 |
| 8,167,311 | B1 * | 5/2012 | Wang | 273/451 |
| 8,448,948 | B1 * | 5/2013 | Shoemaker, Jr. | 273/447 |
| 8,561,994 | B1 * | 10/2013 | Jeong et al. | 273/451 |
| 2013/0049300 | A1 * | 2/2013 | Yang et al. | 273/445 |
| 2013/0292907 | A1 * | 11/2013 | Jeong et al. | 273/447 |

* cited by examiner

*Primary Examiner* — Raleigh W Chiu

(57) ABSTRACT

The present invention provides a gift storage device of a gift game machine and a selection output means thereof. The gift game machine has the selection output means movable in X, Y, Z axes to correspond to a plurality of gift storage devices. Each gift storage device includes a gift support for allowing gifts to hang thereon and a rotary feeding set controlled by the selection output means. A spiral element of the rotary feeding set rotates to push the gifts on the gift support, so that the gifts can move on the gift support until they leave the gift support. Each gift storage device is positioned to a back plate of the gift game machine via an insertion frame. Tabs and insertion troughs are provided between the gift storage device and the insertion frame, so that the gift storage device can be disassembled or assembled easily.

9 Claims, 8 Drawing Sheets

GIFT STORAGE DEVICE OF GIFT GAME MACHINE AND SELECTION OUTPUT MEANS THEREOF

BACKGROUND OF THE INVENTION

1. Field of the Invention

The present invention relates to a gift game machine having a plurality of axially rotatable gift storage devices. The gifts are sequentially hung on the gift storage devices. The gift storage devices are controlled by a selection output means to output the selected gift.

2. Description of Prior Art

FIG. 1 shows a conventional gift game machine having a plurality of spiral gift storage devices 1. Gifts are sequentially hung on each gift storage device 1. Motors 2 are arranged to correspond to the gift storage devices 1 respectively. A player chooses a desired gift and then activates the motor 2 of the gift storage device 1 containing the selected gift, whereby the gift storage device 1 of interest can axially rotate to output the gifts contained therein until the foremost gift leaves the gift storage device 1.

The above-mentioned gift game machine has the following problems: the motors 2 are arranged to correspond to the gift storage devices 2 respectively, so that the number of the motors 2 and the gift storage devices 1 is inevitably increased. As a result, the cost of the gift game machine, and the amount of electricity consumed by the whole machine are increased greatly. If the number of the gift storage devices is to be changed (added or subtracted) based on the standards of the gifts or the locations of the gift storage devices on the gift game machine are to be adjusted, the motors and gift storage devices have to be disassembled and assembled one by one, which needs a lot of labor hours. Therefore, adjusting the number and locations of the gift storage devices also needs to spend a lot of money.

SUMMARY OF THE INVENTION

The objective of the present invention is to solve the problem in prior art that the motors are arranged to correspond to the gift storage devices respectively in the conventional gift game machine. The solution of the present invention is to employ a selection output means which is movable along X, Y, Z axes to control a plurality of gift storage devices. In this way, the number of the motors, the cost of the gift game machine, and the amount of electricity consumed by the whole machine are reduced. Further, the control and maintenance of the whole gift game machine becomes less complicated. On the other hand, in the present invention, one motor is arranged to control the operations of a plurality of gift storage devices. Thus, the problem in prior art that the disassembly of the gift storage devices may be interfered with the arrangement of the motors is solved. Since the structure of the present invention facilitates the disassembly of the gift storage devices, the number and locations of the gift storage devices on a back plate of the gift game machine can be adjusted free and easily based on the standards (such as number, dimension, weight, pitch) of the gifts.

The present invention provides a gift storage device of a gift game machine, including:

a gift support, a first end of the gift support being inclined downwardly to form an exhaust plate;

a base, a plurality of tabs and insertion troughs being provide between the base and an insertion frame of a back plate of the gift game machine, a rotary feeding set comprising a main rod, a first connecting element, a second connecting element, a spiral element, and a rotary claw, the first connecting element being pivotally connected to the base, a first end of the main rod being connected to the first connecting element, a second end of the main rod being fixedly connected to a first end of the second connecting element, the spiral element being put on the main rod, a first end of the spiral element being fixed to the first connecting element, a combining portion provided on the rotary claw being fixed to a second end of the second connecting element.

The present invention further provides a selection output means of a gift game machine, wherein the selection output means is selectively connected to the gift storage device and includes:

a carrier;

a set of rails fixed on the carrier;

a sliding element assembled on the rail;

a linear actuator configured to control a reciprocating movement of the sliding element on the rail; and a rotation driving device assembled on the sliding element and selectively connected to the gift storage device for driving the gift storage device.

DETAILED DESCRIPTION OF THE INVENTION

Figure 7:
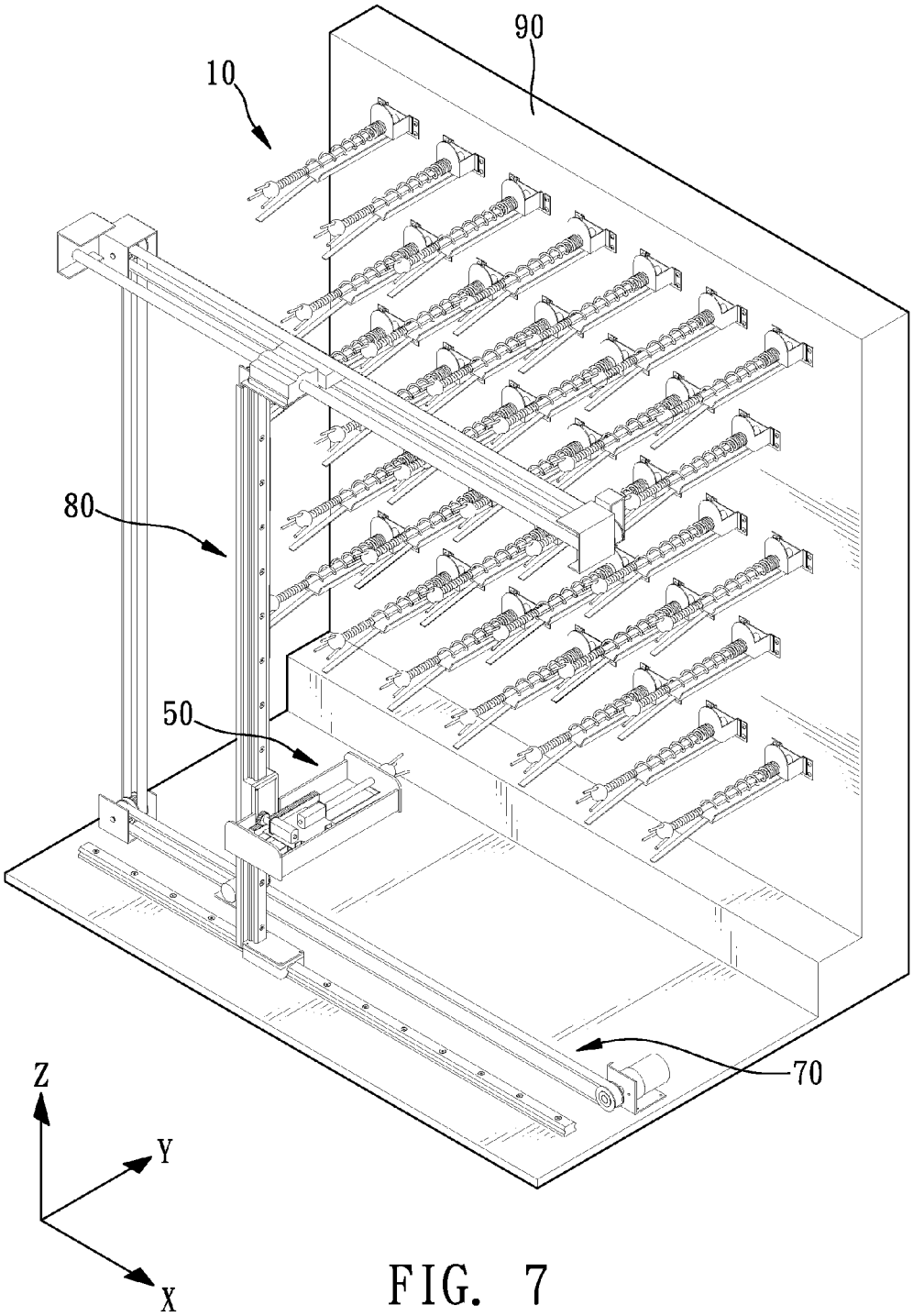
FIG. 7 is a schematic view showing one arrangement of the selection output means and the gift storage device of the present invention.

As shown in FIG. 7, the present invention provides a gift game machine, which includes a plurality of detachable gift storage devices 10 and a selection output means 50.

Figure 1:
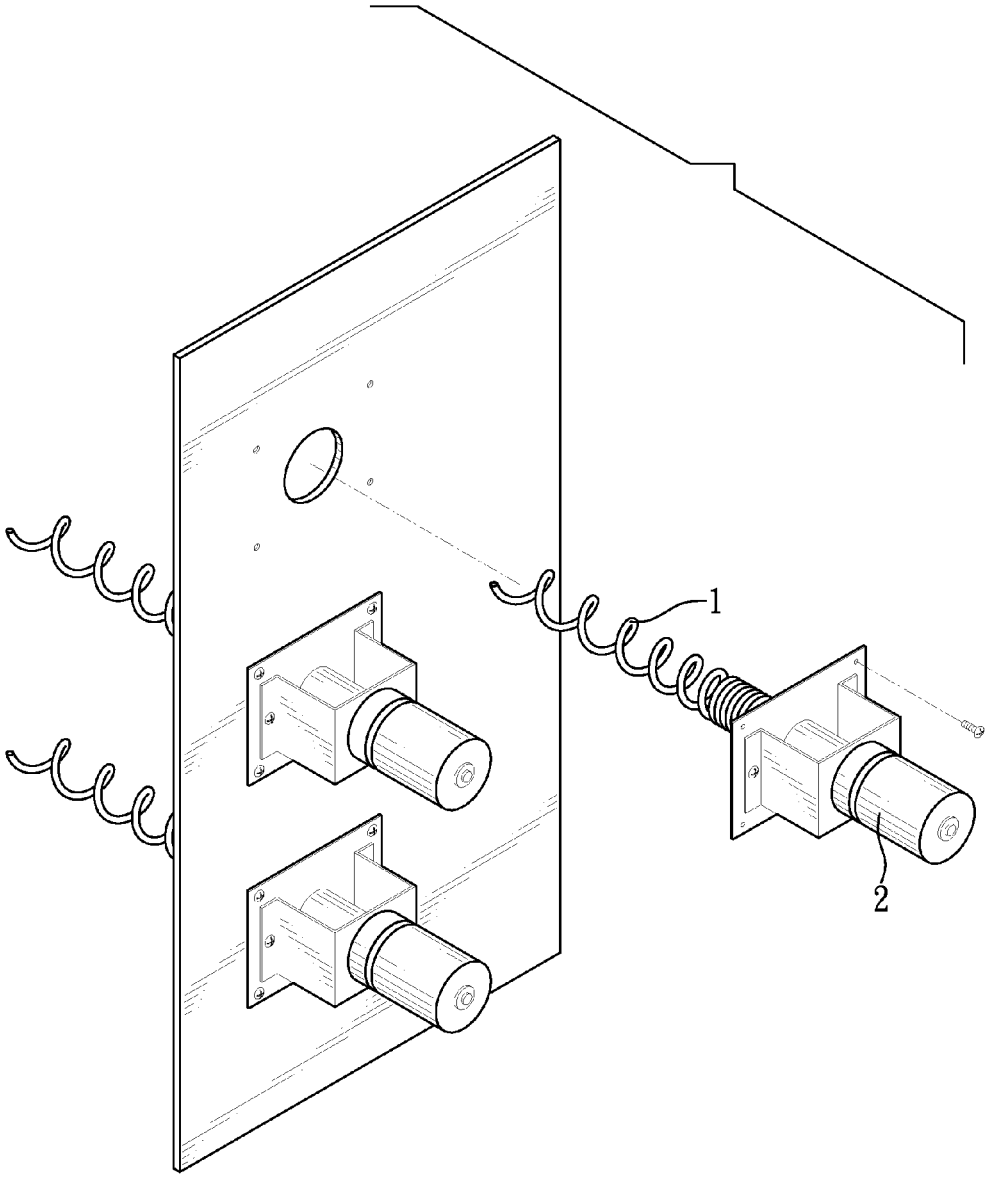
FIG. 1 PRIOR ART
FIG. 1 is a schematic view showing the gift storage devices and the motors of the conventional gift game machine.
Figure 2:
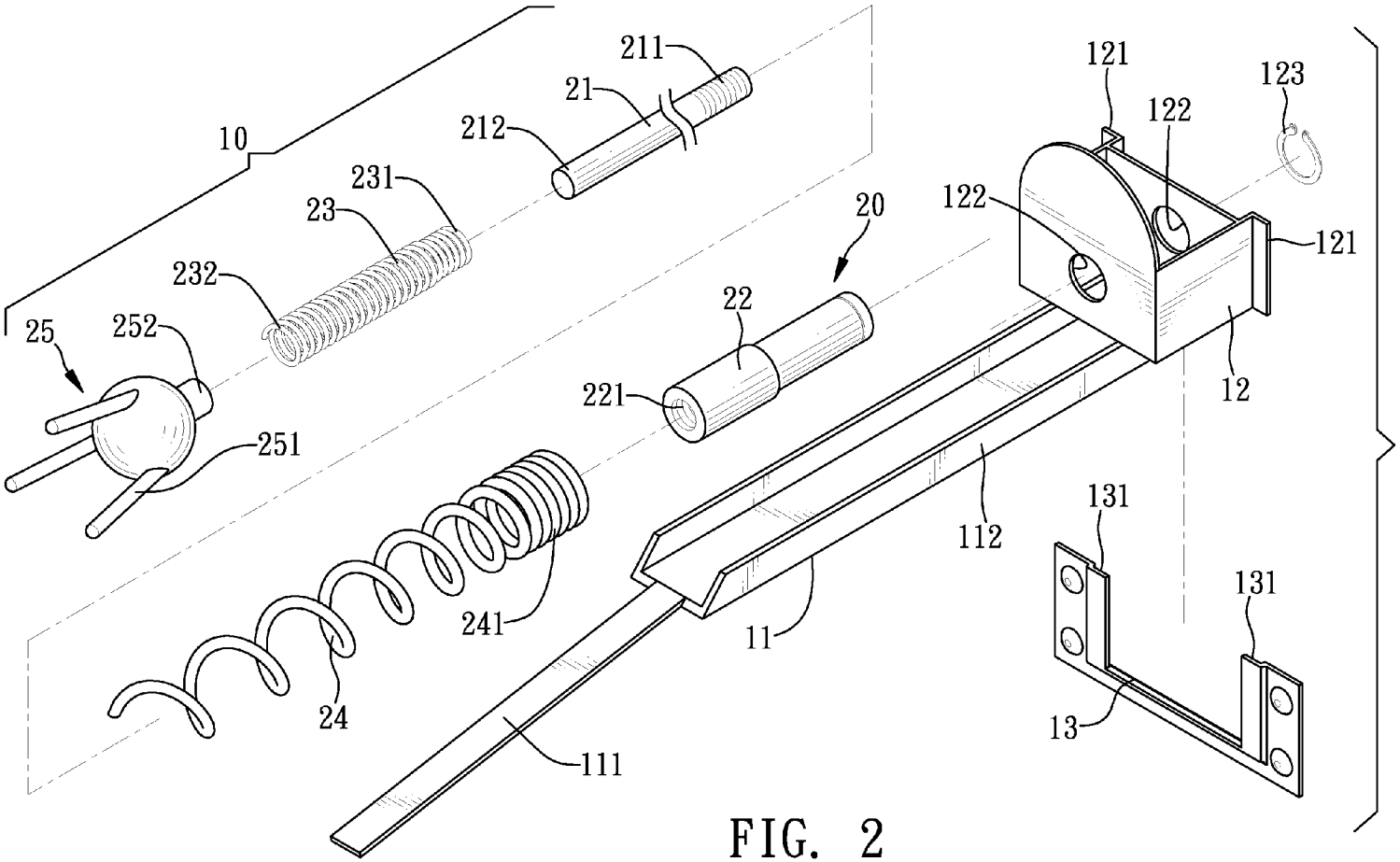
FIG. 2 is an exploded perspective view showing the gift storage device of the present invention.
Figure 3:
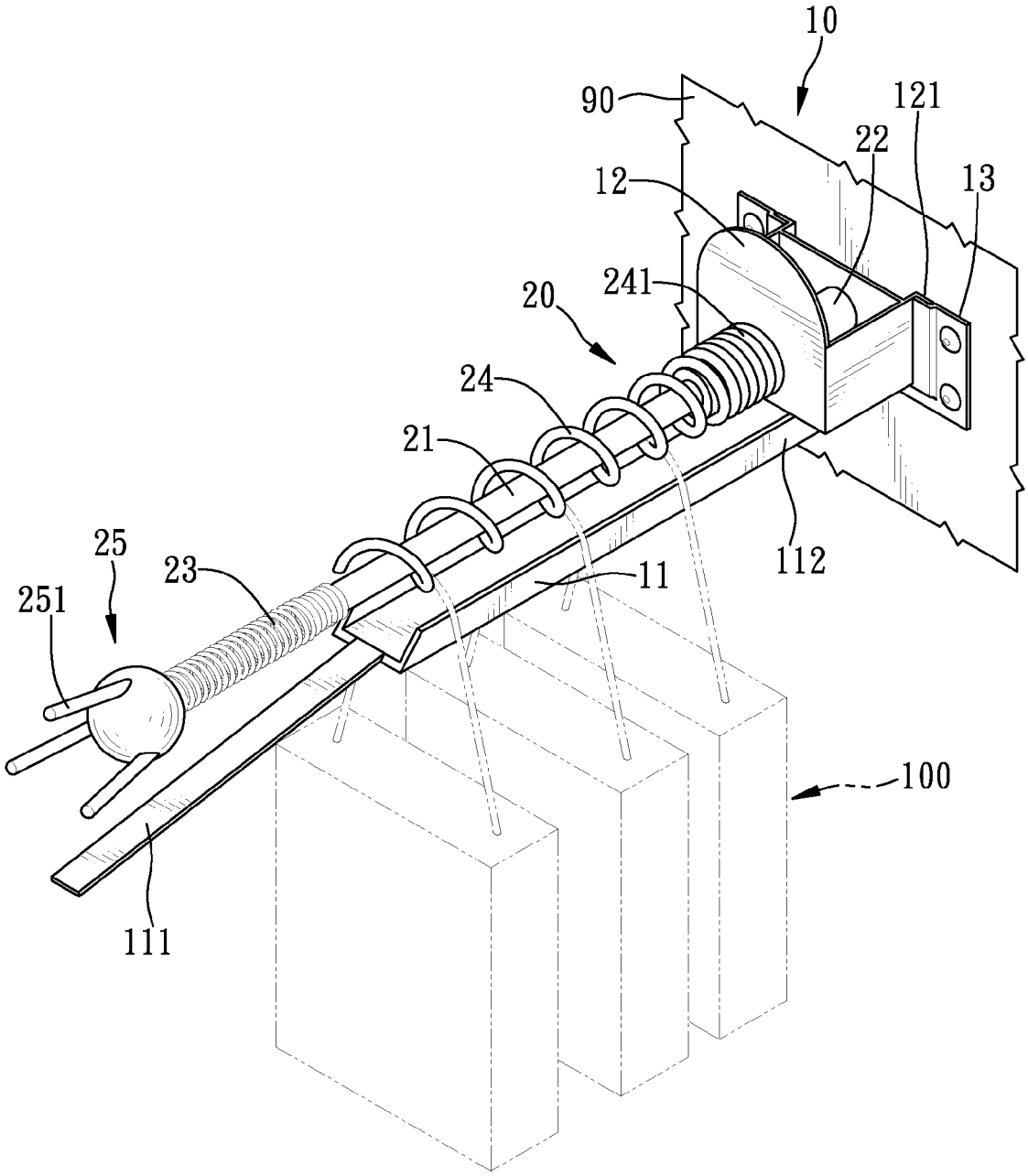
FIG. 3 is an assembled view showing the external appearance of the gift storage device of the present invention.
Figure 4:
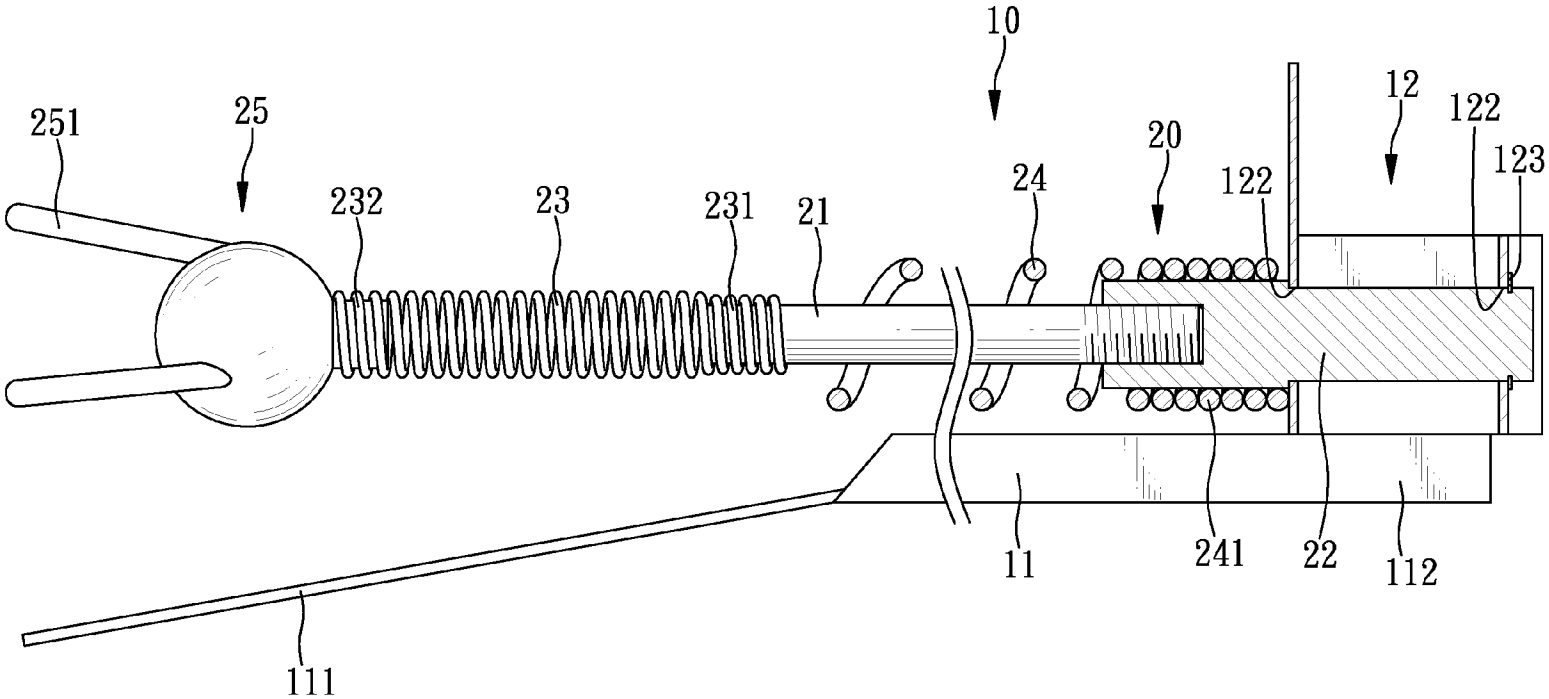
FIG. 4 is a side view showing the gift storage device of the present invention.

As shown in FIGS. 2 to 4, the detachable gift storage device 10 includes a gift support 11, a base 12, an insertion frame 13, and a rotary feeding set 20.

The gift support 11 has a U-shaped cross section and extends in a certain length. A first end 111 of the gift support 11 is inclined downwardly to form an exhaust plate. A second end 112 of the gift support 11 is combined with the base 12. An insertion frame 13 is fixed to a back plate 90 of the gift game machine by screws. Tabs 121 and insertion troughs 131 are formed between the base 12 and the insertion frame 13. The insertion troughs 131 are formed as top openings of the insertion frame 13, whereby each tab 121 can disassembly enter a corresponding one of the insertion trough 131 for mounting the base 12. A plurality of gifts 100 are hung on the gift support 11 at equal intervals.

The rotary feeding set 20 includes a main rod 21, a first connecting element 22, a second connecting element 23, a spiral element 24, and a rotary claw 25.

The main rod 21 is a cylindrical body of a certain length. A first end 211 of the main rod 21 is provided with outer threads. A first end of the first connecting element 22 has an inner threaded hole 221 for allowing the outer threads of the main rod 21 to be threadedly connected therein. The first connecting element 22 is pivotally connected into a connecting hole 122 of the base 12 with its end being fixed by a retaining ring 123, thereby preventing the first connecting element 22 from separating from the base 12 and maintaining the freedom of rotation of the first connecting element 22 in the connecting hole 122. The spiral element 24 is configured as a spring put on the main rod 21. A first end 241 of the spiral element 24 has a dense spiral pitch for providing a constricting force on the first connecting element 22. The second connecting element 23 is configured as a spring having a dense spiral pitch. The first end 231 of the second connecting element 23 is arranged to constrict the second end 212 of the main rod 21. The rotary claw 25 has a plurality of radial sub-claws 251. The back of the rotary claw 25 extends to have a post-like combining portion 252. The second end 232 of the second connecting element 23 is arranged to constrict the post-like combining portion 252.

Figure 5:
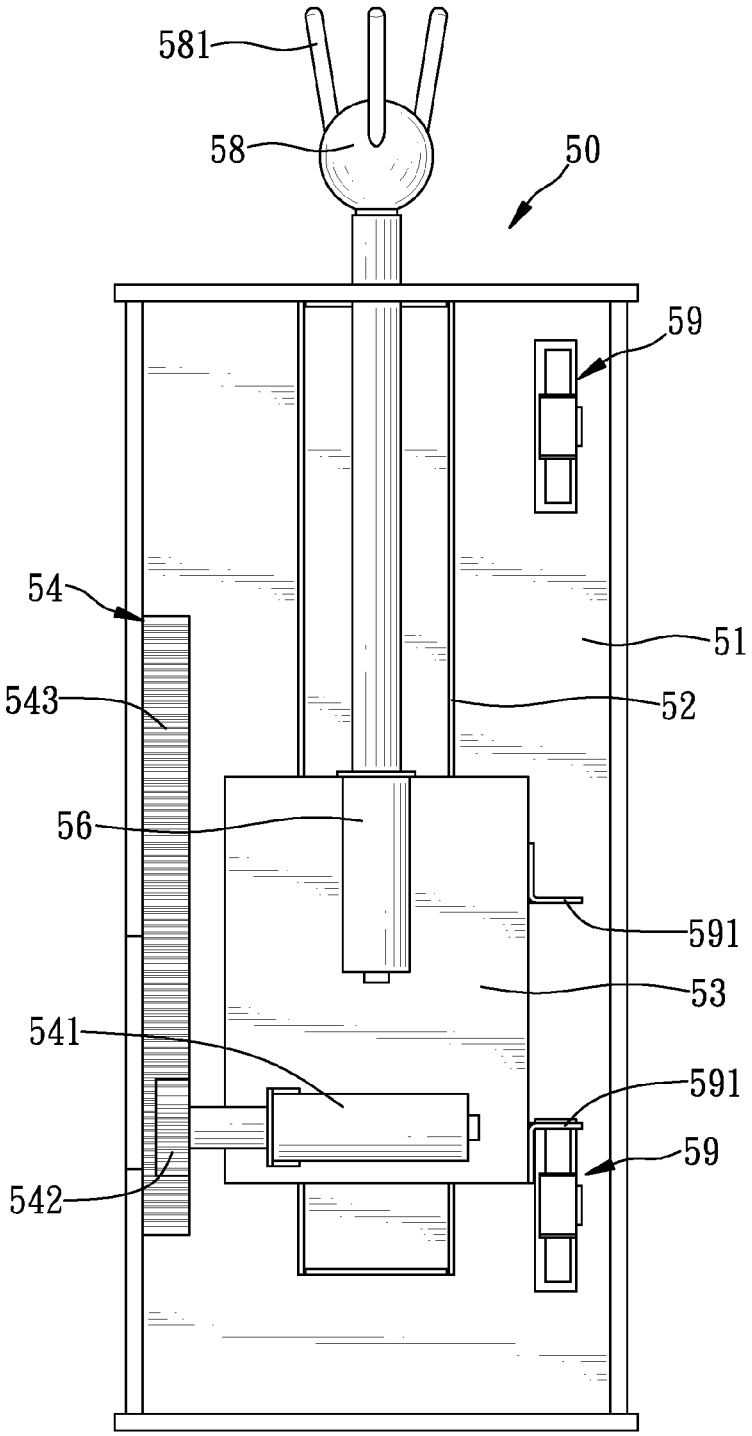
FIG. 5 is a top view showing the selection output means of the present invention.
Figure 6:
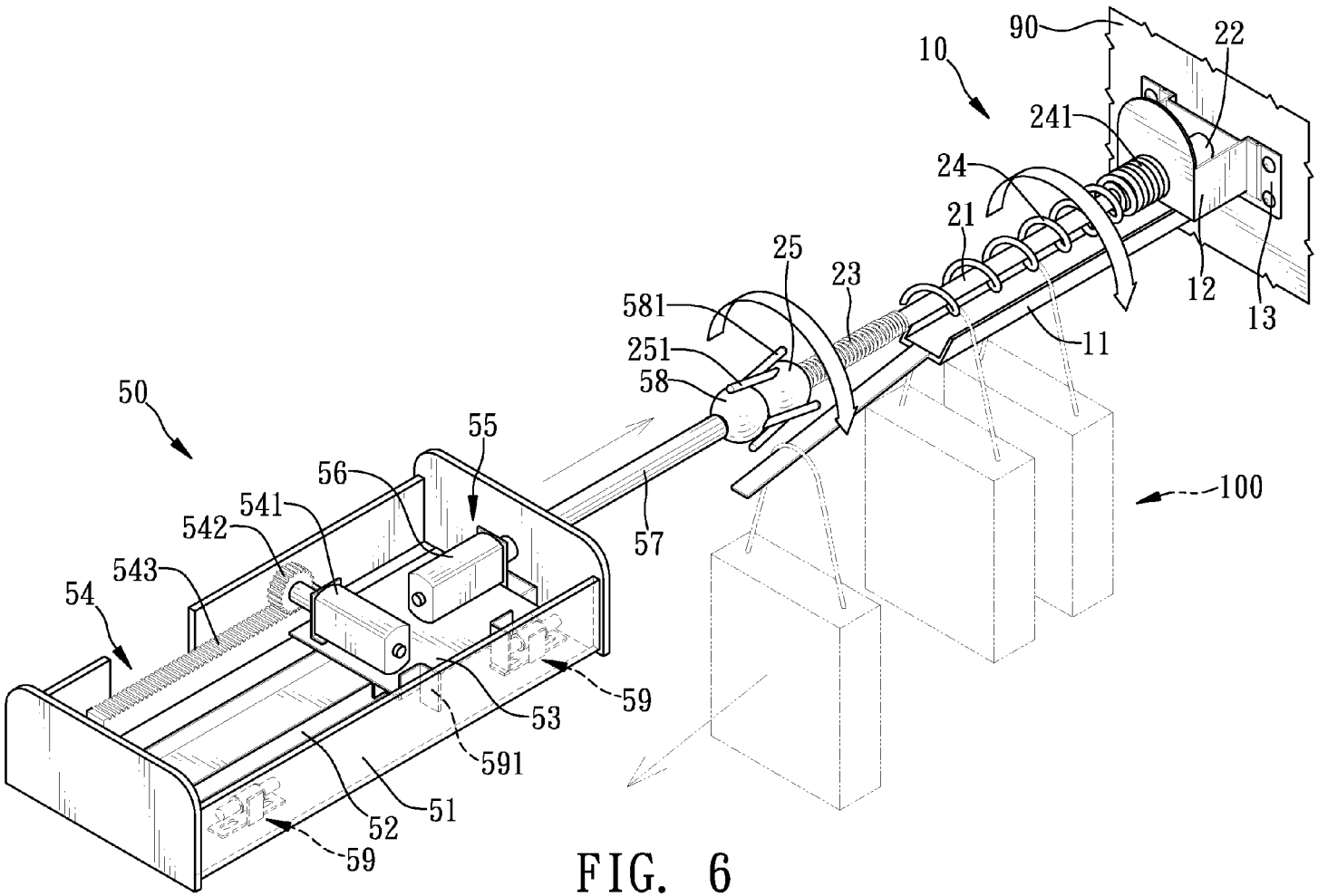
FIG. 6 is a perspective view showing the combination of the selection output means and the gift storage device of the present invention.

As shown in FIGS. 5 to 7, the selection output means 50 includes a carrier 51, a set of rails 52 fixed to the carrier 51, a sliding element 53 assembled on the rails 52, a linear actuator 54 for controlling a reciprocating movement of the sliding element 53 on the rails 52, and a rotation driving device 55 assembled on the sliding element 53.

The linear actuator 54 includes a first motor 541 assembled on the sliding element 53, a gear 542 mounted on a rotation shaft of the first motor 541, and a rack 543 fixed on the carrier 51 and engaged with the gear 542. When the first motor 541 is activated, the gear 542 rotates clockwise or counterclockwise to move on the rack 543, thereby driving the sliding element 53 to reciprocate on the rail 52. In order to restrict the travelling stroke of the sliding element 53, the carrier 51 is provided with two limit switches 59. The sliding element 53 is provided with at least one trigger element 591. When the sliding element 53 arrives a predetermined location, the trigger element 591 touches the corresponding limit switch 59 at the predetermined location. The limit switch 59 will generate a signal to stop the rotation of the first motor 541, thereby stopping the sliding element 53.

The rotation driving device 55 includes a second motor 56 assembled on the sliding element 53, an extension element 57 connected to a rotation shaft of the second motor 56, and a rotary claw 58 connected to a free end of the extension element 57. The rotary claw 58 has a plurality of radial sub-claws 581.

As shown in FIG. 6, when the first motor 541 is activated, the first motor 541 drives the sliding element 53 to cause the rotation driving device 55 to move toward the gift storage device 10. After the rotary claw 58 of the rotation driving device 55 contacts the rotary claw 25 of the gift storage device 10, the sub-claws 215 of the rotary claw 25 are engaged with the sub-claws 581 of the rotary claw 58 to generate an effect for restricting the rotation. At this time, the first motor 541 stops. Then, the second motor 56 is activated, the rotating power of the second motor 56 is transmitted to the rotary claw 25 of the gift storage device 10 via the extension element 57 and the rotary claw 58. The rotating power of the rotary claw 25 is transmitted to the main rod 21 via the second connecting element 23. The rotation of the main rod 21 drives the first connecting element 22 and the spiral element 24 connected therewith to rotate synchronously. The spiral element 24 spirally pushes the gifts 100 hung on the gift support 11, so that the gifts 100 moves along the gift support 11 until the foremost gift 100 leaves the gift support 11 to fall off the exhaust plate at the first end 111. After the selected gift 100 is outputted, the second motor 56 stops and the gift storage device 10 also stops outputting the gift by rotation. Then, the first motor 541 is activated to cause the rotation driving device 55 to retract until the rotary claw 58 of the rotation driving device 55 to be separated from the rotary claw 25 of the gift storage device 10.

Since the second connecting element 23 is a spring having a dense spiral pitch, the second connecting element 23 generates an elastic deformation when the rotary claw 25 contacts the rotary claw 58, thereby making the rotary claw 25 to easily contact the rotary claw 58 in a manner that the sub-claws 251 and the sub-claws 581 are staggered to each other. The elastic force of the second connecting element 23 can prevent the gift storage device 10 from vibrating if the action forces between the rotary claws 25 and 58 are transmitted to the main rod 21. Further, the second connecting element 23 having a dense spiral pitch can reduce the consumption of rotation torsion, so that the rotation torsion received by the rotary claw 25 can be transmitted to the main rod 21 more effectively.

Figure 8:
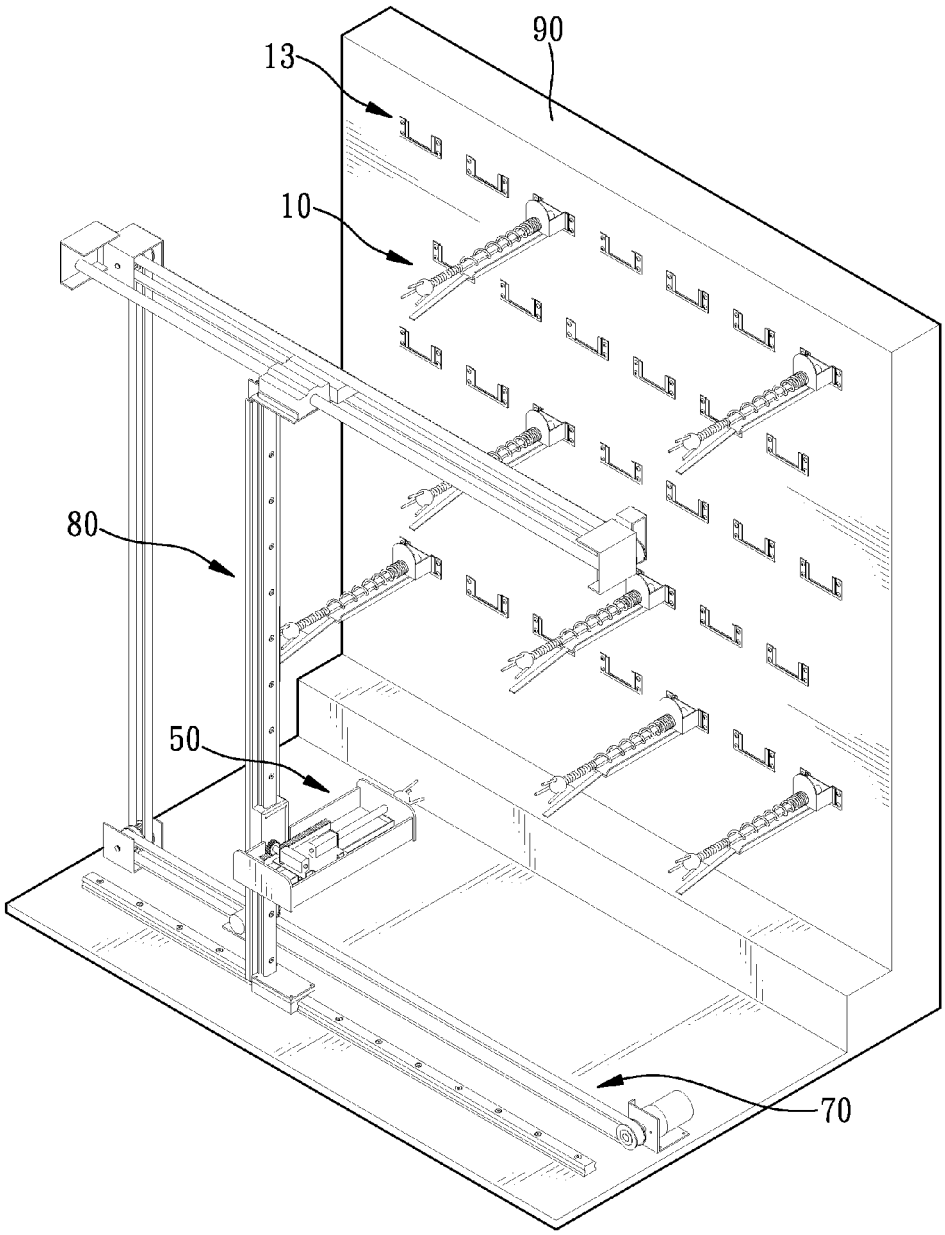
FIG. 8 is a schematic view showing another arrangement of the selection output means and the gift storage device of the present invention.

As shown in FIGS. 7 and 8, the selection output means 50 is further controlled by an X-axis linear actuator 70 and a Y-axis linear actuator 80. With the reciprocation of the extension element 57 and the rotary claw 58, the selection output means 50 can move along the X, Y, and Z axes of the gift game machine, thereby selecting a gift storage device 10 from an array of the gift storage devices 10 for outputting the gift.

Since the base 12 and the insertion frame 13 of the gift storage device 10 are combined with each other by means of the tabs 121 and the insertion troughs 131, the gift storage devices 10 can be disassembled and assembled easily. An array of insertion frames 13 can be arranged on the back plate 90 of the gift game machine. The locations of the gift storage devices 10 can be adjusted based on the standards (such as number, dimension, weight and pitch) of the gifts. As shown in FIG. 7, each insertion frame 13 is assembled with a gift storage device 10. Alternatively, as shown in FIG. 8, some of the insertion frames 13 are assembled with the gift storage devices 10.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A gift storage device of a gift game machine and a selection output means thereof, characterized in that:

the gift storage device comprises a gift support, a base, and a rotary feeding set, a first end of the gift support is inclined downwardly to form an exhaust plate, the base is connected to a second end of the gift support and fixed to a back plate of the gift game machine, the rotary feeding set comprises a main rod, a first connecting element, a second connecting element, a spiral element, and a rotary claw, the first connecting element is pivotally connected to the base, a first end of the main rod is connected to the first connecting element, a second end of the main rod is fixedly connected to a first end of the second connecting element, a second end of the second connecting element is fixedly connected to a post-like combining portion of the rotary claw, the spiral element is put on the main rod, a first end of the spiral element is fixed to the first connecting element; and the selection output means selectively connects to and drives the rotary claw, the selection output means comprises a carrier, a set of rails fixed on the carrier, a sliding element assembled on the rail, a linear actuator configured to control a reciprocating movement of the sliding element on the rail, and a rotation driving device assembled on the sliding element.

2. The gift storage device of a gift game machine and the selection output means thereof according to claim 1, wherein the gift storage device further comprises an insertion frame fixed to the back plate of the gift game machine, a plurality of tabs and insertion troughs are provided between the insertion frame and the base, whereby each tab disassembly enters the insertion trough for mounting the base.

3. The gift storage device of a gift game machine and the selection output means thereof according to claim 1, wherein the main rod of the rotary feeding set is connected to the first connecting element by threads.

4. The gift storage device of a gift game machine and the selection output means thereof according to claim 1, wherein the spiral element of the rotary feeding set is a configured as a spring, a first end of the spiral element has a dense spiral pitch for constricting outside the first connecting element.

5. The gift storage device of a gift game machine and the selection output means thereof according to claim 1, wherein the second connecting element of the rotary feeding set is a configured as a spring having a dense spiral pitch, a first end and a second end of the second connecting element are configured to constrict the main rod and the post-like combining portion of the rotary claw.

6. The gift storage device of a gift game machine and the selection output means thereof according to claim 1, wherein the linear actuator of the selection output means includes a first motor assembled on the sliding element, a gear mounted on a rotation shaft of the first motor, and a rack fixed to the carrier and engaged with the gear.

7. The gift storage device of a gift game machine and the selection output means thereof according to claim 1, wherein the selection output means further comprises a pair of limit switches provided on the carrier, the sliding element is provided with a trigger element for triggering the limit switches.

8. The gift storage device of a gift game machine and the selection output means thereof according to claim 1, wherein the rotation driving device of the selection output means includes a second motor assembled on the sliding element, an extension element connected to a rotation shaft of the second motor, and a rotary claw connected to a free end of the extension element.

9. The gift storage device of a gift game machine and the selection output means thereof according to claim 1, wherein the selection output means further includes an X-axis linear actuator and a Y-axis linear actuator connected to the gift game machine.

* * * * *